US006402271B1

(12) United States Patent
Kelley et al.

(10) Patent No.: US 6,402,271 B1
(45) Date of Patent: Jun. 11, 2002

(54) COMPUTER CABINET WITH EXTENDING LIGHT

(75) Inventors: James O. Kelley, Spring Lake; Greg Persons, Wyoming; Ralph J. Byma, Zeeland, all of MI (US)

(73) Assignee: Sligh Furniture Co., Holland, MI (US)

( * ) Notice: Subject to any disclaimer, the term of this patent is extended or adjusted under 35 U.S.C. 154(b) by 0 days.

(21) Appl. No.: 09/285,149

(22) Filed: Apr. 1, 1999

Related U.S. Application Data

(63) Continuation of application No. 08/929,346, filed on Aug. 27, 1997, which is a continuation-in-part of application No. 08/428,530, filed on Apr. 25, 1995, now Pat. No. 5,678,905, which is a continuation-in-part of application No. 29/007,733, filed on May 3, 1993, now Pat. No. Des. 357,599, and a continuation-in-part of application No. 29/037,658, filed on Apr. 17, 1995, now Pat. No. Des. 376,491, and a continuation-in-part of application No. 29/037,654, filed on Apr. 17, 1995, now Pat. No. Des. 376,496.

(51) Int. Cl.[7] ..... A47B 17/00

(52) U.S. Cl. ..... 312/196; 362/133; 312/223.3; 312/223.5; 312/270.5; 312/310

(58) Field of Search ..... 312/204, 223.3, 312/223.5, 114, 270.1, 270.3, 312.5, 205, 196, 258, 262, 194, 195, 326, 291, 310, 298, 301; 362/33, 133, 270, 428

(56) References Cited

U.S. PATENT DOCUMENTS

| | | | | | |
|---|---|---|---|---|---|
| 444,151 | A | * | 1/1891 | Hull | 312/301 X |
| 1,129,800 | A | * | 2/1915 | Harris | 312/301 X |
| 1,668,232 | A | * | 5/1928 | Coppes | 312/301 X |
| 3,339,994 | A | * | 9/1967 | Reddig et al. | 312/301 |
| 3,694,595 | A | * | 9/1972 | Horecky | 200/61.76 |
| 4,651,258 | A | * | 3/1987 | Davis et al. | 362/147 |
| 4,669,790 | A | * | 6/1987 | Briggs | 312/223.3 |
| 4,783,724 | A | * | 11/1988 | Wilson et al. | 362/133 |
| 5,586,816 | A | * | 12/1996 | Geiss, II | 312/310 X |
| 5,611,553 | A | * | 3/1997 | Schoeman et al. | 312/223.3 X |
| 5,842,758 | A | * | 12/1998 | Kelley | 312/196 |
| 6,073,623 | A | * | 6/2000 | Maschhoff | 126/25 R |

* cited by examiner

*Primary Examiner*—Peter M. Cuomo
*Assistant Examiner*—Stephen Vu
(74) *Attorney, Agent, or Firm*—Waters & Morse, P.C.

(57) ABSTRACT

A computer cabinet with extending light has a front and an opposing back. The computer cabinet includes opposing first and second side panels, a door, a first drawer, a second drawer, and a lamp. The first and second side panels are spaced apart from and generally parallel with one another, and further extend generally vertically upward from a supporting floor. The first drawer is slidably connected with one of the first and second side panels, whereby the first drawer slides between extended and retracted positions. The first drawer extends out the front of the computer cabinet in the extended position and is retracted into the computer cabinet in the retracted position. The first drawer also has a drawer front. The second drawer is slidably connected with the first drawer, whereby the second drawer slides between extended and retracted positions. The second drawer extends out the front of the first drawer in the extended position and is retracted into the first drawer in the retracted position. The lamp is slidably connected with one of the first and second side panels, whereby the lamp slides between extended and retracted positions. The lamp extends out the front of the computer cabinet in the extended position and is retracted into the computer cabinet in the retracted position. The lamp further includes a position responsive switch that switches the lamp on or off when the lamp moves between the extended and retracted positions.

17 Claims, 11 Drawing Sheets

COMPUTER CABINET WITH EXTENDING LIGHT

CROSS-REFERENCES TO RELATED APPLICATIONS

This is a continuation in part application of co-pending U.S. patent application Ser. No. 08/929,346, entitled CONCEALED DESK and filed on Aug. 27, 1997, by James O. Kelley, the disclosure of which is incorporated here by reference, which is a continuation in part of applicant's co-pending patent application Ser. No. 08/428,530, entitled CONCEALED DESK and filed on Apr. 25, 1995, by James O. Kelley, now U.S. Pat. No. 5,678,905, issued Oct. 21, 1997, the disclosure of which is incorporated here by reference, which is a continuation in part of applicant's co-pending patent applications: Ser. No. 29/007,733, entitled COMPUTER WORKSTATION and filed on May 3, 1993, now U.S. Pat. No. D 357,599, issued Apr. 25, 1995, the disclosure of which is incorporated here by reference; Ser. No. 29/037,658, entitled COMPUTER SECRETARY and filed on Apr. 17, 1995, now U.S. Pat. No. D 376,491, issued Dec. 17, 1996, the disclosure of which is incorporated here by reference; and Ser. No. 29/037,654, entitled COMPUTER WORKPLACE and filed on Apr. 17, 1995, now U.S. Pat. No. D 376,496 issued Dec. 17, 1996, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to an item of furniture that conceals a desk. More particularly, the item of furniture presents an appearance of a traditional article of storage furniture in which the front of the storage furniture is closed by doors that conceal the presence of the desk.

The presence of an office in the home is an increasing trend. A home office may be used for household finances or for doing business work at home. A popular use of a home office is for the operation of a computer in the home. Home offices typically include a desk, file storage, and drawer storage.

With a premium on space in most homes and apartments, it is not always possible to dedicate a room solely to a home office, and even when a room can be dedicated solely to a home office, it is commonly desired to give the home office a more homey appearance than conventional office furniture typically provides. For these reasons, it is desirable to incorporate a desk, storage compartments, and computer hardware into a furniture unit that can be closed to conceal the fact that the unit is actually a desk and to conceal storage and computer hardware, for example. A desk and accompanying storage compartments that are encloseable by doors to create the impression of a conventional home storage cabinet, buffet, or computer cabinet, for example, and that are openable to provide a fully functioning desk are clearly desirable for the home office.

Further, computer hardware does not lend itself to blending in with traditional executive offices. Thus, the ability to conveniently access and conceal computer equipment in item of furniture that presents an appearance of traditional storage furniture is very desirable.

BRIEF SUMMARY OF THE INVENTION

Accordingly, a computer cabinet with extending light of the invention has a front and an opposing back. The Computer cabinet includes opposing first and second side panels, a door, and a first drawer. The first and second side panels are spaced apart from and generally parallel with one another, and further extend generally vertically upward from a supporting floor. The door is hingedly connected with one of the first and second side panels, whereby the door hinges between open and closed positions. At least a portion of the front of the computer cabinet is covered by the door when the door is in the closed position. Conversely, the front of the computer cabinet is uncovered when the door is in the open position. The first drawer is slidably connected with one of the first and second side panels, whereby the first drawer slides between extended and retracted positions. The first drawer extends out the front of the computer cabinet in the extended position and is retracted into the computer cabinet in the retracted position. The first drawer also has a drawer front.

In one aspect of the invention, the computer cabinet further includes a second drawer. The second drawer is slidably connected with the first drawer, whereby the second drawer slides between extended and retracted positions. The second drawer extends out the front of the first drawer in the extended position and is retracted into the first drawer in the retracted position.

In another aspect of the invention, the computer cabinet further includes a lamp. The lamp is slidably connected with one of the first and second side panels, whereby the lamp slides between extended and retracted positions. The lamp extends out the front of the computer cabinet in the extended position and is retracted into the computer cabinet in the retracted position. The lamp may further include a position responsive switch that switches the lamp on or off when the lamp moves between the extended and retracted positions.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
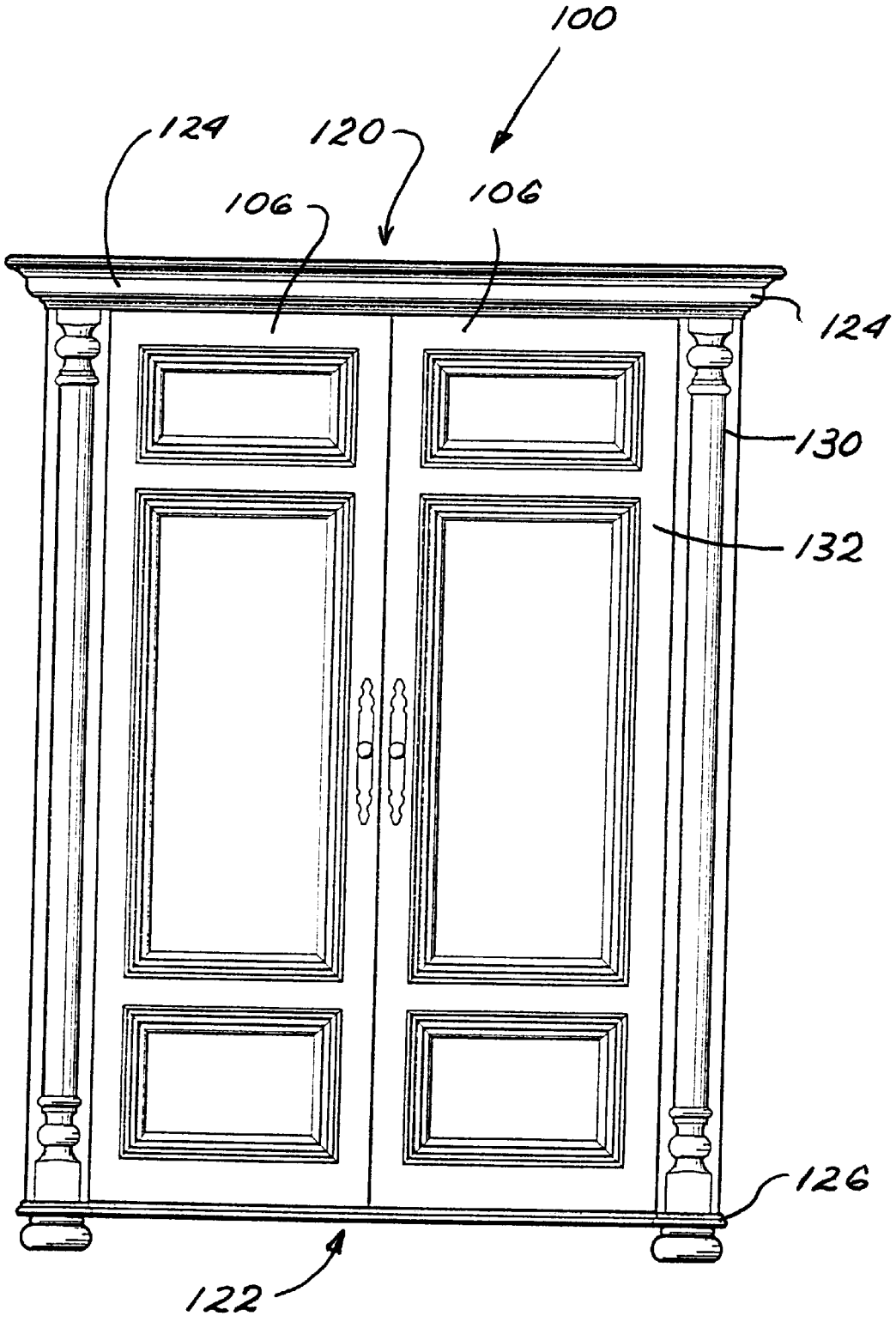
FIG. 1 is a front elevational view of an COMPUTER CABINET WITH EXTENDING LIGHT according to the invention.

A computer cabinet with extending light according to the invention is generally disclosed in the drawing figures. More particularly, the computer cabinet 100 has opposing first and second side panels 102 and 104, respectively, a door 106, a first drawer 108, a second drawer 110, and a lamp 112 (FIGS. 1–4). Additional storage shelving 114 and drawers 116, either adjustable or fixed, for example, may also be provided. The computer cabinet 100 may be constructed of any suitable cabinet making material, using any method that is appropriate to the material selected.

The opposing first and second side panels 102 and 104, respectively, are spaced apart from and generally parallel with one another. The first and second side panels 102 and 104, respectively, are also oriented to extend generally vertically upward from a supporting floor (not shown). Interconnecting horizontal shelf-like member may be provided to define a top 120 and a bottom 122 of the computer cabinet 100. An intermediate shelf or work surface 125 may also be provided at an elevational position that approximates a typical desk height. A decorative crown molding 124 or base line molding 126 or other design features may also be provided, as will be understood by one having ordinary skill in the art.

At least one door 106 is hingedly connected with one or the other of the first and second side panels 102 and 104, respectively. The door 106 swings or hinges between open and closed positions. In the closed position (FIG. 1), the door 106 covers and conceals at least a portion of a front of the computer cabinet 100. While in the open position (FIGS. 2–11), the front of the computer cabinet 100 is most preferably totally revealed and the door 106 does not obstruct access to the front of the computer cabinet and the storage contained therein. Depending upon the selected design requirements of a manufacturer or user, for example, the door 106 may be designed to swing fully around and lay flat against the respective side panel 102 or 104, respectively, or be limited to a lesser swing arc.

Figure 2:
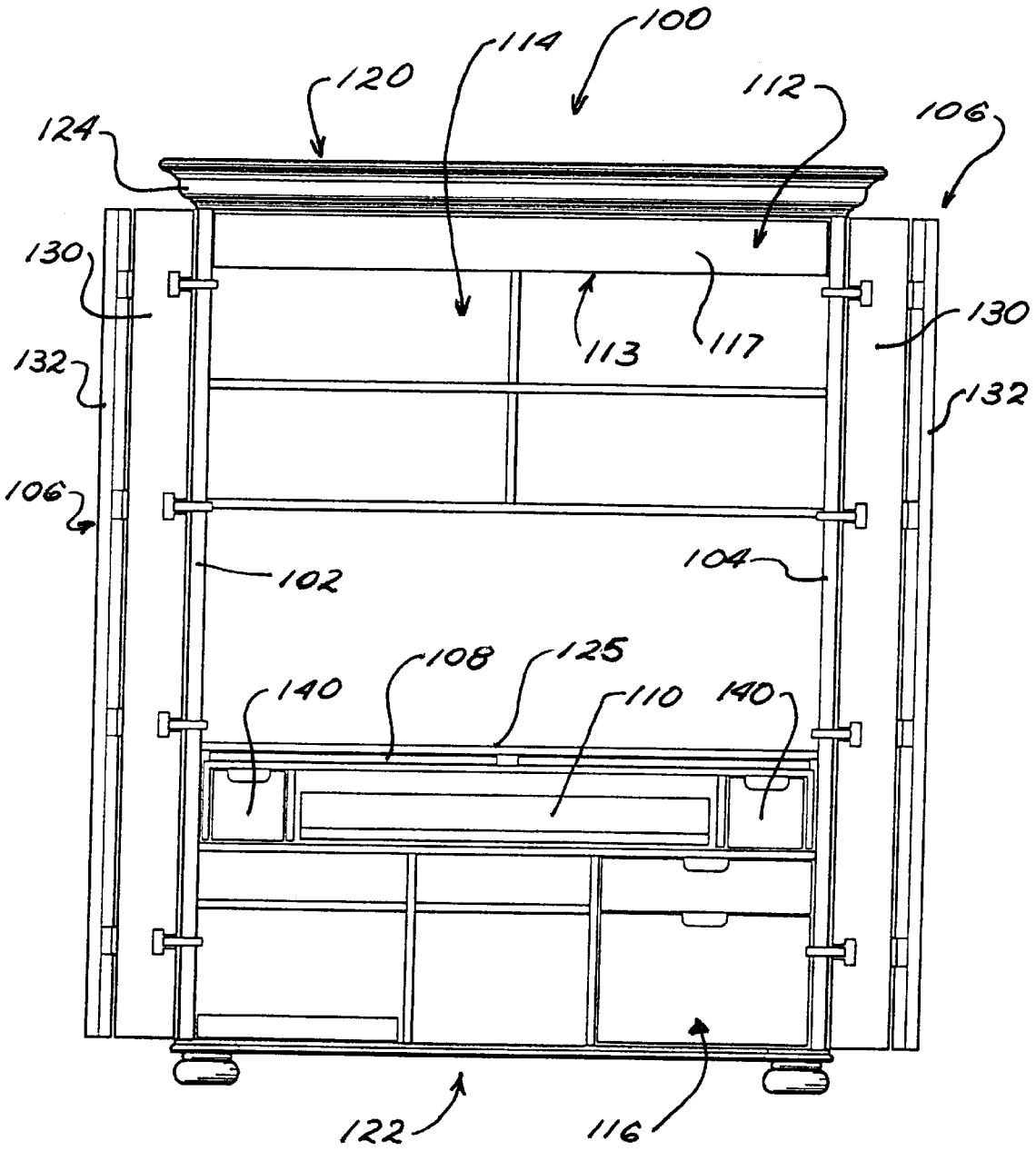
FIG. 2 is the view of FIG. 1 with the doors open.
Figure 3:
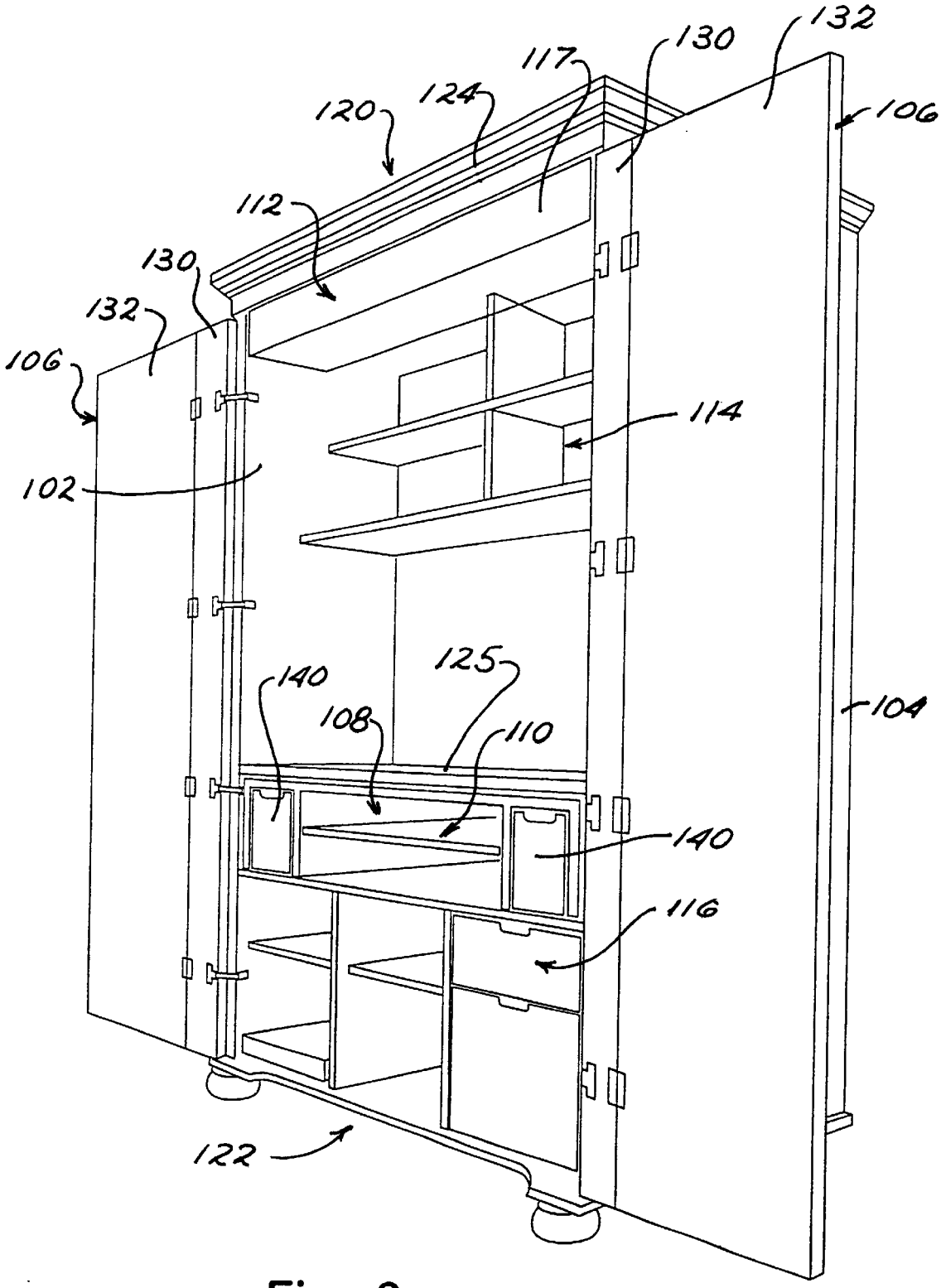
FIG. 3 is a lower right perspective view thereof.
Figure 4:
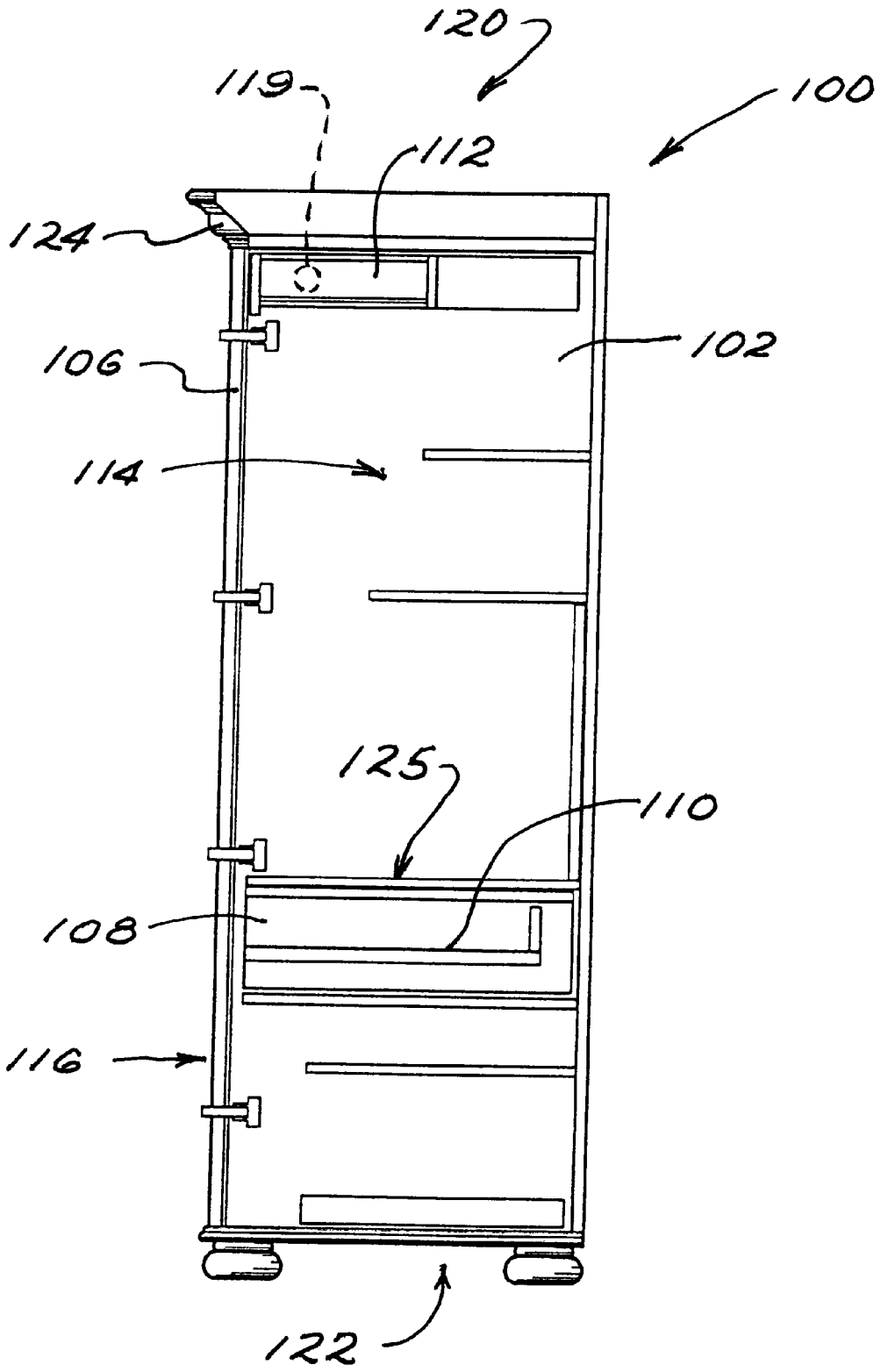
FIG. 4 is a cross-sectional view along line IV—IV of FIG. 2.
Figure 5:
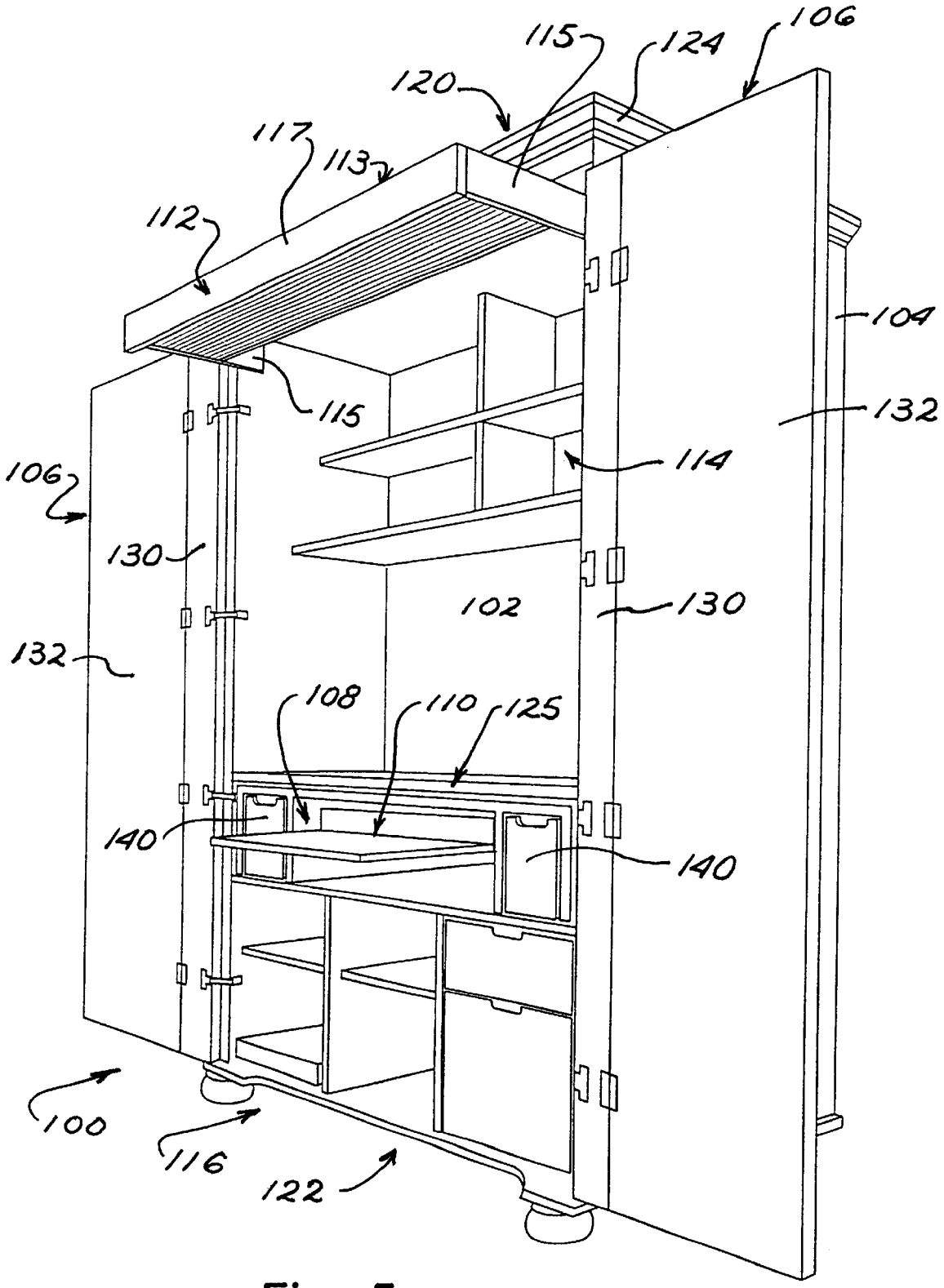
FIG. 5 is the view of FIG. 3 with the light drawer and tray extended.
Figure 6:
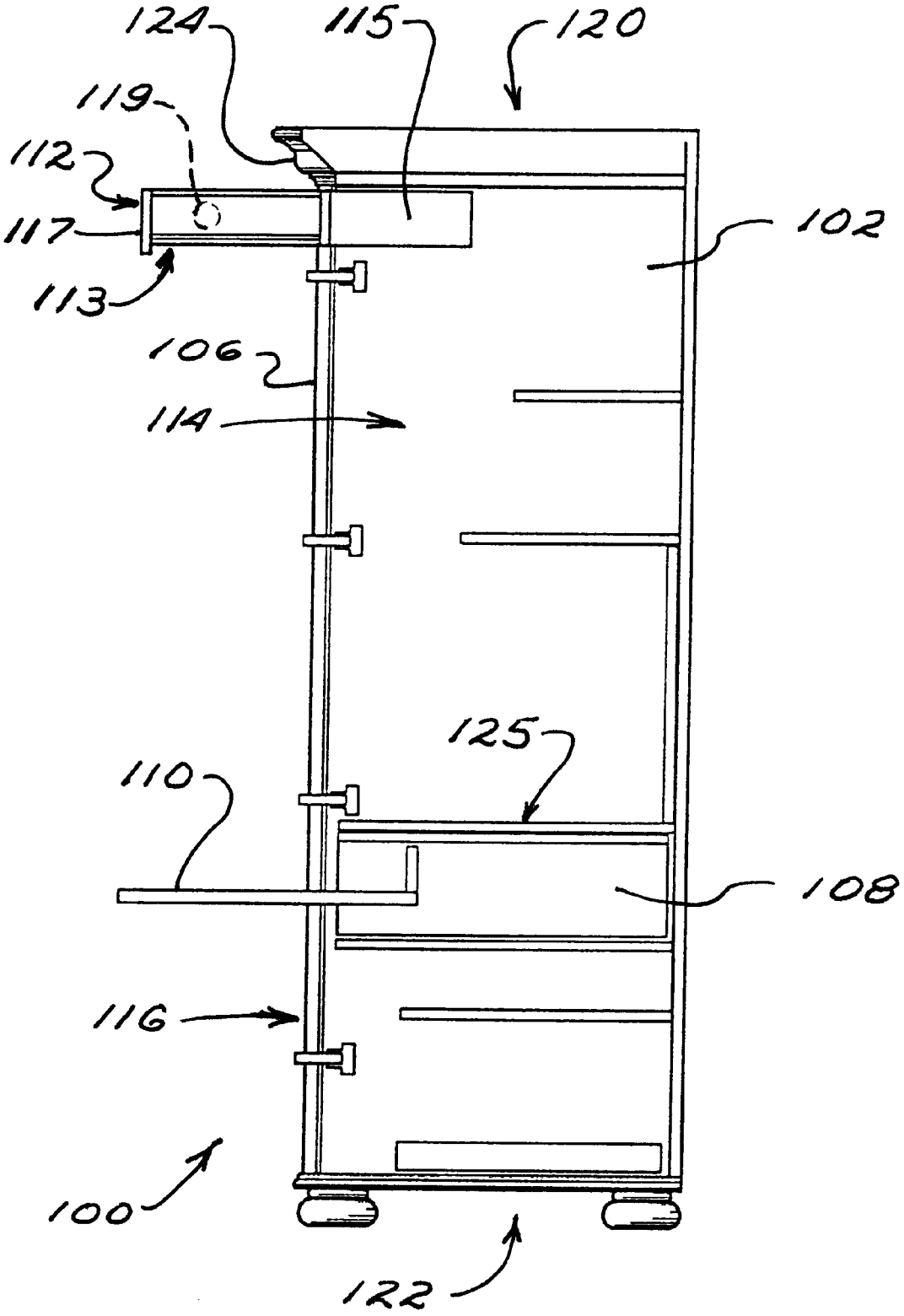
FIG. 6 is the view of FIG. 4 with the light drawer and tray extended.
Figure 7:
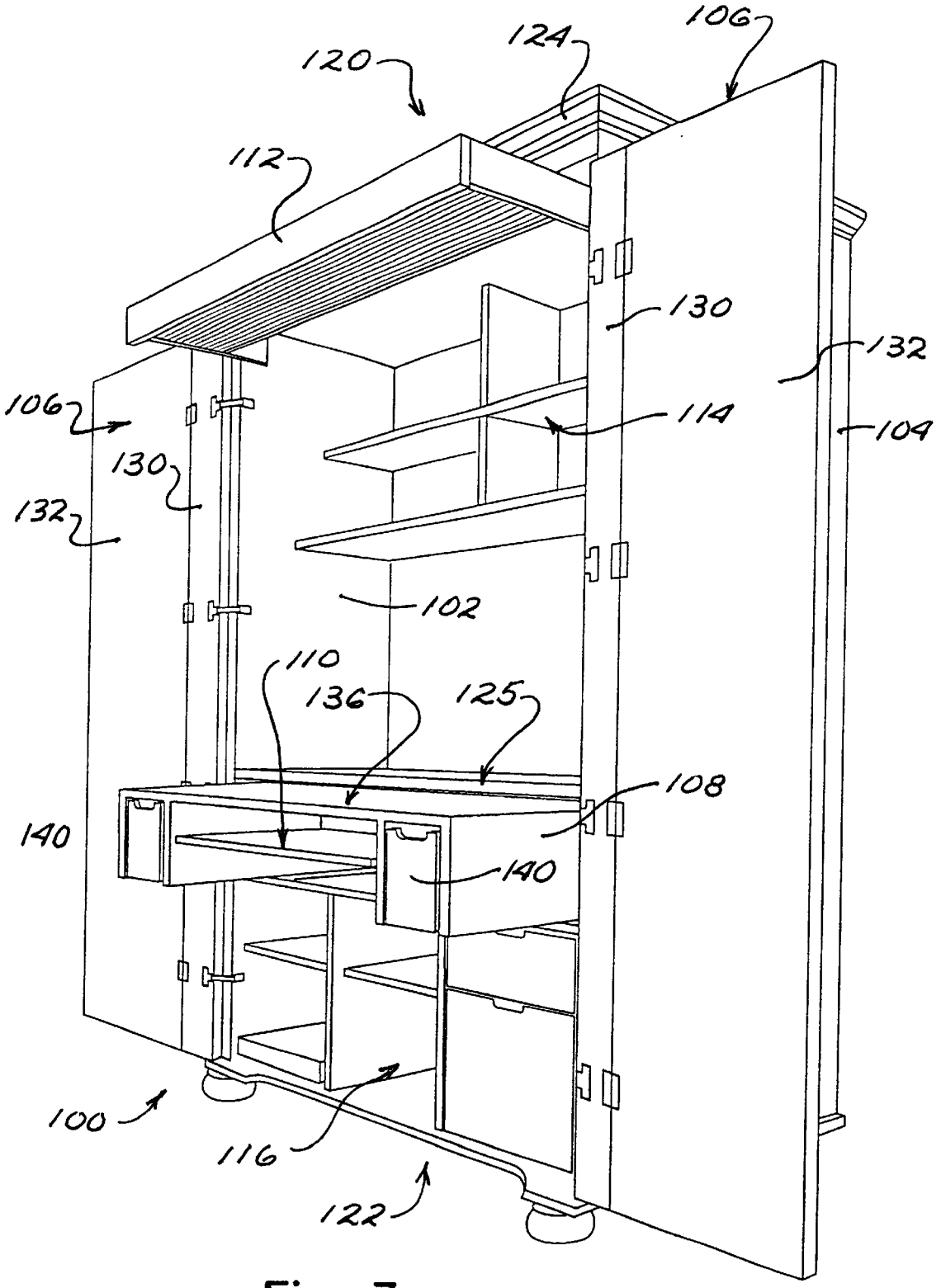
FIG. 7 is the view of FIG. 3 with the light drawer and work drawer extended.
Figure 8:
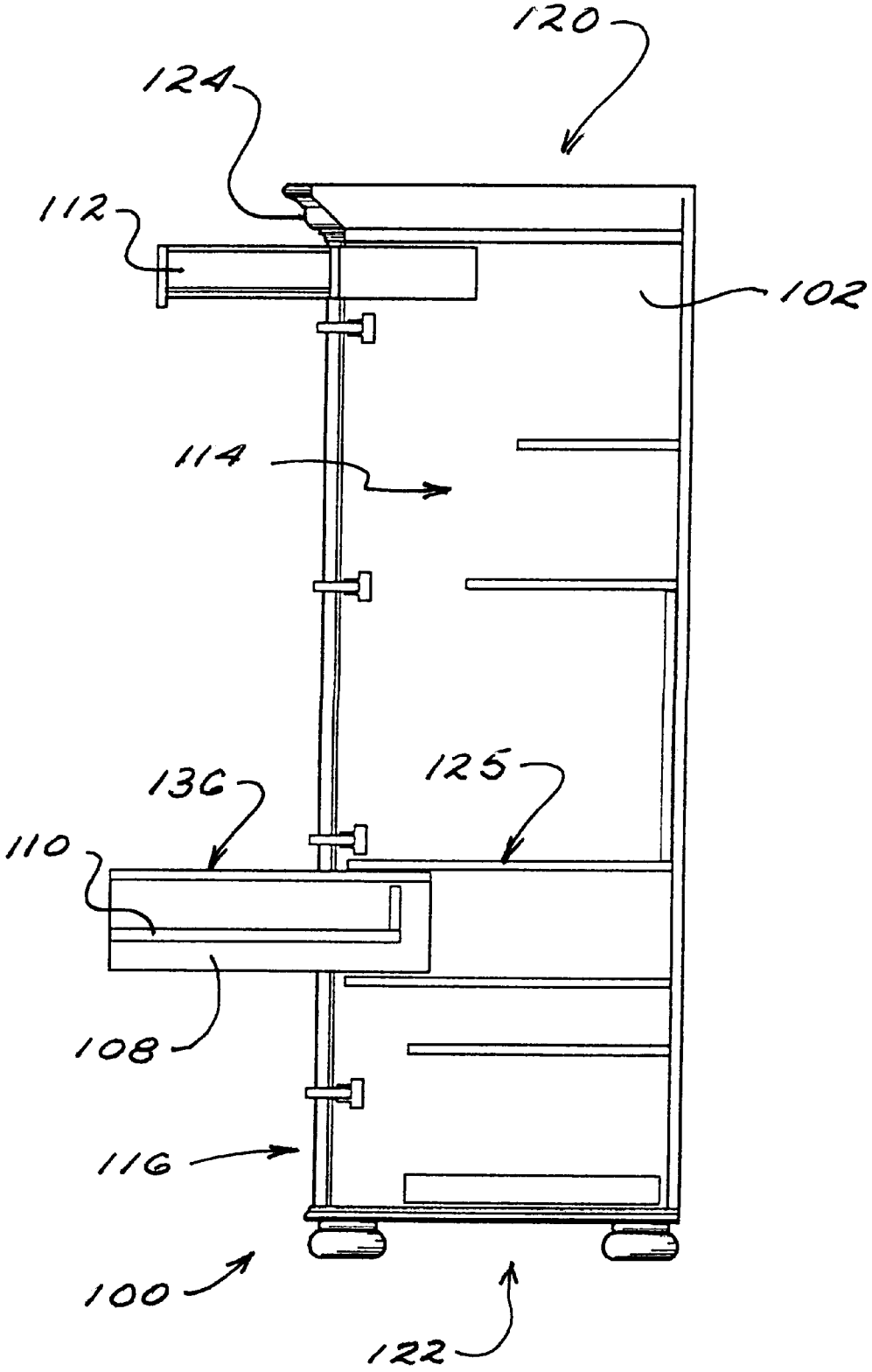
FIG. 8 is the view of FIG. 4 with the light drawer and work drawer extended.
Figure 9:
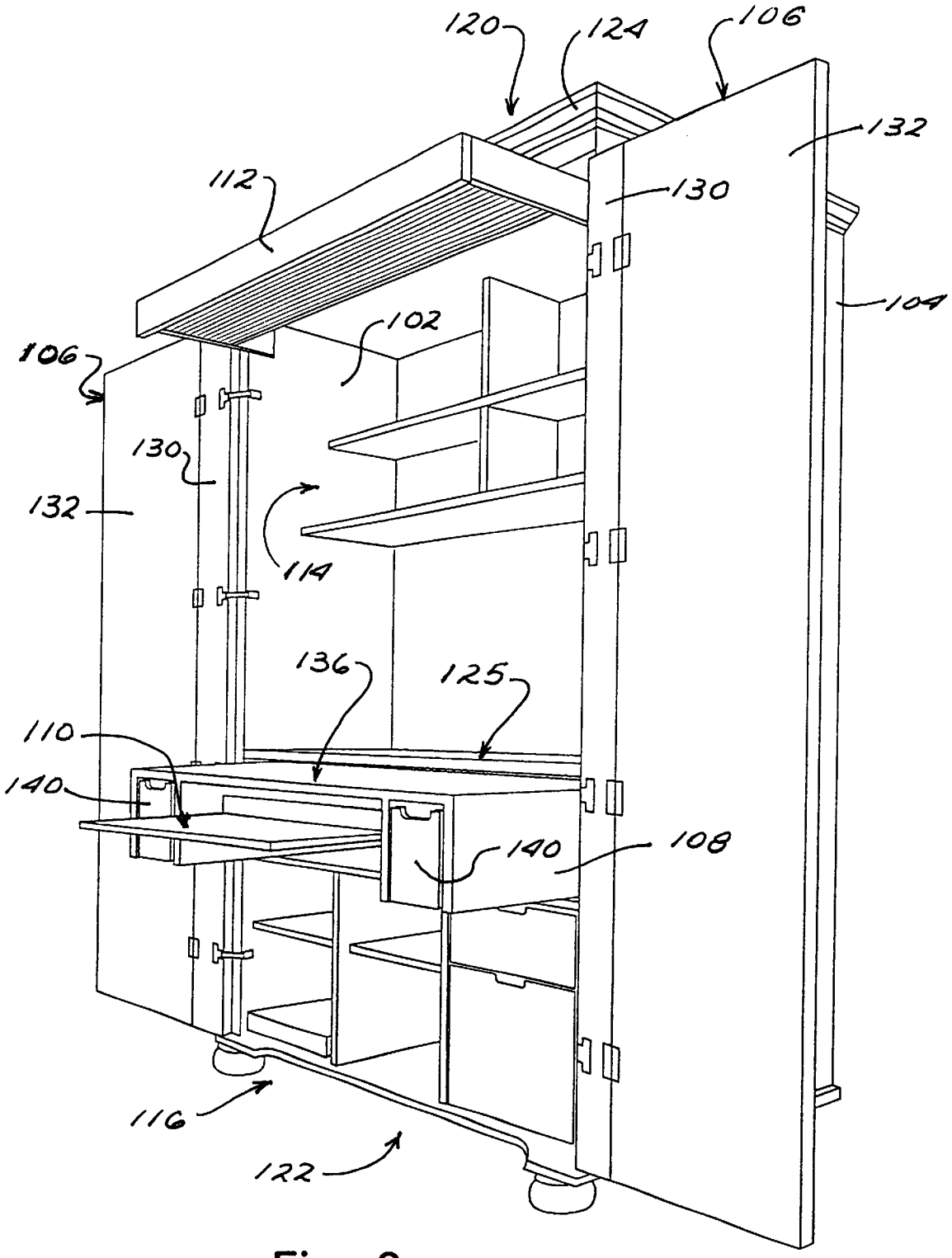
FIG. 9 is the view of FIG. 3 with the light drawer, the work drawer, and the tray extended.
Figure 10:
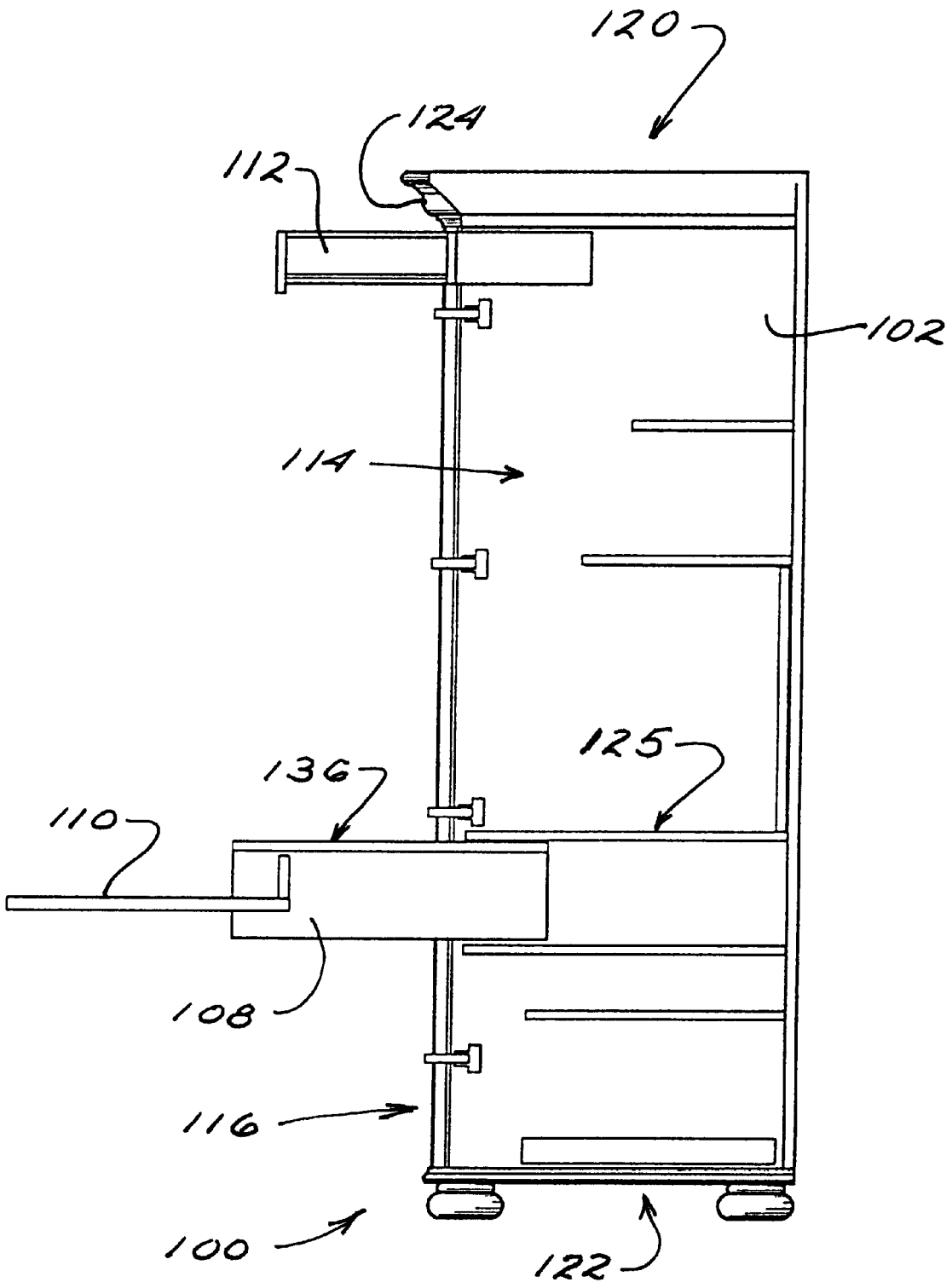
FIG. 10 is the view of FIG. 4 with the light drawer, the work drawer, and the tray extended.
Figure 11:
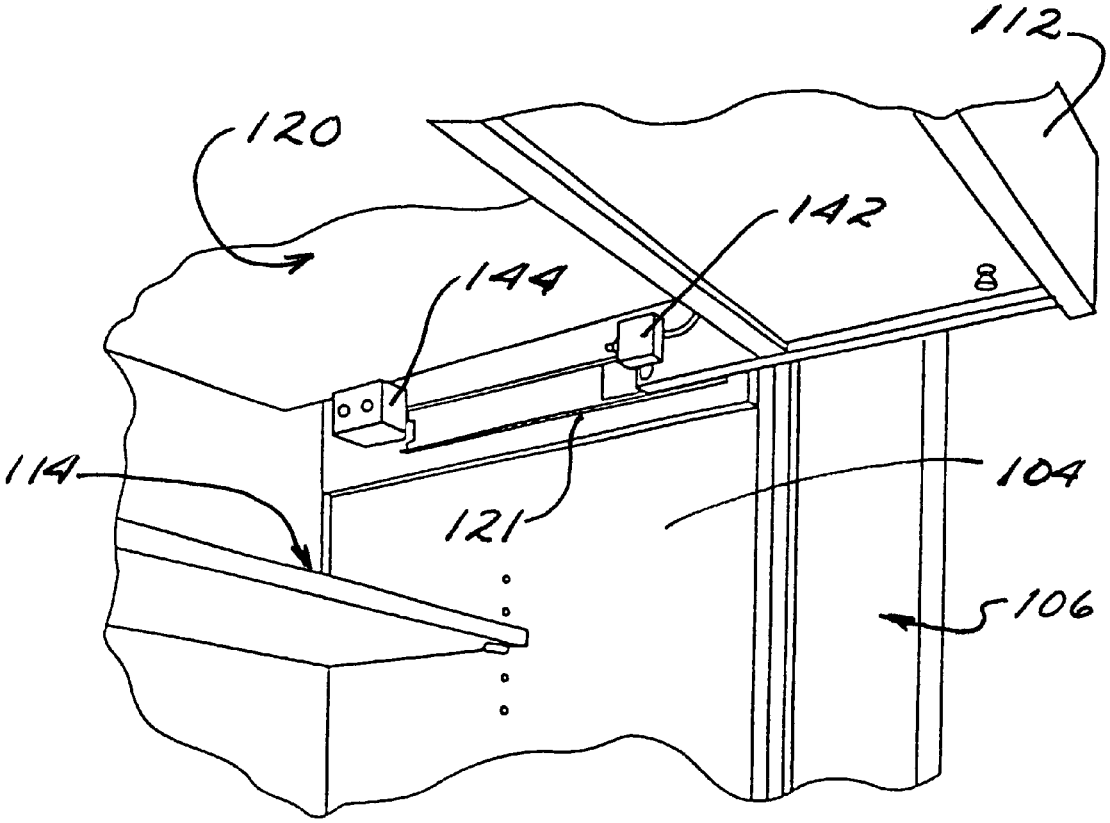
FIG. 11 is an enlarged detail, showing a fragmentary, lower left perspective view of the light drawer slide and switch assembly.

Most preferably, two doors 106 are provided and sized to completely cover the front of the computer cabinet 100 when the doors 106 are in their closed positions (FIG. 1). As shown, the doors 106 are provided with first and second door panels 130 and 132, respectively, that are hingedly interconnected (FIGS. 2 and 3). The first door panel 130 is substantially larger in width than the second door panel 132, which may be a narrow or thin vertical strip of material. This two panel construction of the doors 106 provides a number of structural and aesthetic benefits, which will be appreciated by one having ordinary skill in the art. One of the structural benefits is that the doors 106 may be made to swing fully around and lay against the side panels 102 and 104, respectively, with the use of common furniture leaf hinges, rather than requiring specialized hardware. One of the aesthetic design benefits is continuity of line. As is best shown in FIG. 1, the door panels 130 may give an appearance of a fixed support column, for example, when the panel 130 actually hinges open to give unrestricted access to the interior of the computer cabinet 100.

The first drawer 108 is constructed of any suitable drawer material, using any method that is appropriate to the material selected. The first drawer 108 is preferably constructed in a box configuration that includes a solid top surface 136 that provides a pull-out work surface. The first drawer or work drawer 108 is slidably connected with at least one of the first and second side panels 102 and 104, respectively. The first drawer 108 thus slides between extended (FIGS. 7 and 8) and retracted positions (FIGS. 1–6), with the first drawer extending out the front of the computer cabinet 100 in the extended position (FIGS. 7 and 8), and being retracted into the computer cabinet in the retracted position (FIGS. 1–6). As is generally shown in the drawing figures, the work drawer 108 is mounted immediately under or adjacent the intermediate shelf or work surface 123, although this is not a requirement of the invention. One having ordinary skill in the art will appreciate that there are numerous ways to slidably mount the first drawer 108 in the computer cabinet 100, with commonly available drawer side hardware, for example.

At least a second drawer or support tray 138 is slidably connected with the work drawer 108 to also slide between extended (FIGS. 5, 6, 9, and 10) and retracted (FIGS. 2–4, 7, and 8) positions, relative to the first drawer. In its extended position (FIGS. 5, 6, 9, and 10), the second drawer 110 extends out from a front of the first drawer 108. The second drawer 110 is retracted into the first drawer 108 in its retracted position (FIG. 2–4, 7, and 8). The second drawer 110 may conveniently be configured as a keyboard tray, for example, so a user may extend the first drawer 108 to avail himself of the desk-like work surface 136 of the first drawer 108, and may further extend the second drawer to access a keyboard or the like, for example, that may be set thereupon. Additional drawers 140 or the like, either storage or support surface or work surface trays, for example, may also be slidably connected with the first drawer.

A common problem of work stations of the type that are designed to appear to be conventional storage furniture, is that inherent constraints of the peripheral cabinet structure comprises task lighting. Thus, the computer cabinet 100 is provided with the pull-out lighting fixture or lamp 112 that is slidably commented with one of the first and second side panels 102 and 104, respectively, so the lamp slides between extended (FIGS. 5–11) and retracted (FIGS. 1–4) positions. In its extended position (FIGS. 5–11), the lamp 112 extends out from the front of the computer cabinet 100 to generally provide illumination downward and into the computer cabinet and its storage or work facilities. In its retracted position (FIGS. 1–4), the lamp 112 is retracted into the computer cabinet 100 and may be concealed behind the doors 106 when they are in their closed positions. Alternative, the lamp 112 may be desirably designed to provide not only downward but also upward, which will provide supplementary or complimentary indirect area lighting. Further, the computer cabinet 100 may be provided with an open top 120 or a light transmitting top panel, whereby the lamp 112 may provide indirect area lighting, even with the lamp is retracted and the doors 106 closed.

As shown, the lamp 112 is a full width fixture that extends fully from one of the two side panels 102 and 104, respectively, to the other side panel, and is slidably connected with the two opposing side panels. The lamp 112 includes a light drawer 113 having spaced side panels 115 and a front panel 117, with a lighting element 119 being mounted in the light drawer and illuminating the work surface downwardly through a light transmitting bottom of the light drawer. The front panel covers and conceals the front of the lighting element when the lamp is retracted. In the illustrated embodiment, the light drawer is slidably mounted in the cabinet by drawer glides 121 interconnecting the drawer side panels with the cabinet side panels. The lamp 112 may include any of various lighting technologies, as will be known to one having ordinary skill in the art. As is shown in the detail of drawing FIG. 11, a contact switch 142 and contact surface 144 may be provided to automatically switch the lamp 112 off, when retracted, and on, when extended. The contact surface 144 shown is a forward facing surface of a stop block that is mounted upon a side panel or may be mounted upon a back panel of the computer cabinet 100.

One having ordinary skill in the art will appreciate that this is merely an exemplary switching arrangement and that various alternative and equivalent switching arrangements may be utilized.

It will also be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

We claim:

1. A computer cabinet having a pull-out light fixture, a front and an opposing back, the computer cabinet comprising:

opposing first and second side panels, the first and the second side panels being spaced apart from and generally parallel with one another, the first and the second side panels extending generally vertically upward from a supporting floor; and a work surface supported above the floor by the first and the second side panels at a position below the top of the side panels;

the light fixture being slidably connected with the cabinet between the first and the second side panels, the light fixture sliding between extended and retracted positions, the light fixture being spaced above the work surface, the light fixture including a lamp that emits illumination upon the work surface at least when in its extended position; and first and second drawers, the first drawer being slidably connected with one of the first and the second side panels, whereby the first drawer slides between extended and retracted positions, the first drawer extending out the front of the computer cabinet in the extended position, the first drawer being retracted into the computer cabinet in the retracted position, the first drawer also having a drawer front, the second drawer being slidably connected with the first drawer, whereby the second drawer slides between extended and retracted positions, the second drawer extending out the front of the first drawer in the extended position, the second drawer being retracted into the first drawer in the retracted position.

2. The computer cabinet defined in claim 1, wherein the first drawer has a top and at least a portion of the top is closed and defines a work surface.

3. The computer cabinet defined in claim 2, wherein the first drawer is generally configured as a sliding tray that provides one of a group of support members, including a work surface and a keyboard tray.

4. A computer cabinet having an extendable light fixture, the computer cabinet comprising:

opposing first and second side panels, the first and second side panels being spaced apart from and generally parallel with one another; and a work surface extending at least partially between the first and second side panels;

the light fixture comprising a light drawer slidably connected with the computer cabinet, the light drawer sliding between extended and retracted positions, whereby the light drawer extends outwardly from a front of the computer cabinet in the extended position and the light drawer is retracted into the computer cabinet in the retracted position, the light drawer extending at least partially between the first and second side panels and being located above the work surface at an elevation above the height of a user in position to work at the work surface; and a light attached to the light drawer, the light emitting illumination downwardly onto the work surface at least when the light drawer is extended.

5. A computer cabinet comprising:

opposing first and second side panels, the first and second side panels being spaced apart from and generally parallel with one another;

a work surface extending at least partially between the first and second side panels;

a lamp slidably connected with the cabinet, the lamp sliding generally horizontally between extended and retracted positions, the lamp extending out a front of the computer cabinet in the extended position, the lamp being retracted into the computer cabinet in the retracted position, the lamp extending at least partially between the first and second side panels and being located above the work surface at an elevation above the height of a typical user positioned to work at the work surface, the lamp being positioned and oriented to direct illumination downwardly onto the work surface.

6. In a desk assembly wherein a storage unit is mounted at an elevated position over at least a rear portion of a work surface, the improvement comprising a pull-out lighting fixture movably mounted to the storage unit for movement between retracted and extended positions, the lighting fixture being at least substantially rearward of a front of the storage unit when in the retracted position and being at least substantially forward of the front of the storage unit when in the extended position, the lighting fixture including a lighting element therein that is positioned over a forward portion of the work surface when the lighting fixture is in the extended position, the lighting element being positioned to project illumination downwardly on a forward portion of the work surface when in the extended position.

7. The improvement according to claim 6 wherein the storage unit comprises a cabinet having spaced side panels that extend upwardly from the work surface to a top that extends between the side panels.

8. The improvement according to claim 7 wherein one or more openable doors enclose an open front of the cabinet, the lighting fixture being positioned so as to be behind the doors when the doors are closed and the lighting fixture is retracted, the lighting fixture extending forwardly of a plane of the closed doors when the doors are open and the lighting fixture is in the extended position.

9. The improvement according to claim 7 wherein the cabinet encloses the work surface, with the cabinet side panels extending from a floor contacting lower edge to the cabinet top, a front of the cabinet being positioned at least as far forward as a front of the work surface and front of the storage unit, one or more openable doors enclosing the front of the cabinet.

10. The improvement according to claim 9 wherein the work surface includes at least one extendable portion that is slidable outwardly from the front of the cabinet when the doors are open, the lighting fixture also extending outwardly from the front of the cabinet so as to provide illumination downwardly on the extendable portion of the work surface.

11. The improvement as in claim 6 wherein the lighting fixture comprises a front panel, the lighting element being positioned behind the panel, the panel thus concealing the front of the lighting element when the lighting fixture is retracted.

12. The improvement according to claim 6 wherein the lighting fixture extends for at least a substantial portion of the distance between sides of the storage unit.

13. The improvement according to claim 12 wherein the lighting fixture includes a front panel that conceals a front of the lighting fixture at least when the lighting fixture is retracted.

14. The improvement according to claim 6 wherein the lighting fixture comprises a light drawer slidably mounted to the storage cabinet for movement between extended and retracted positions, the lighting element being mounted in the light drawer for movement along with the light drawer, the light drawer having a front panel that conceals the lighting element at least when the light drawer is in the retracted position.

15. The improvement according to claim 14 wherein the light drawer is inside the storage unit and is enclosable by doors on the storage unit when the light drawer is retracted.

16. The improvement according to claim 14 wherein the light drawer has spaced side panels that are positioned adjacent inner sides of spaced side panels of the storage unit, the light drawer side panels being slidably mounted to the cabinet side panels by drawer glides.

17. The improvement according to claim 6 and further including a position responsive switch that automatically turns the lighting element on when the light fixture is extended and turns the lighting element off when the light fixture is retracted.

* * * * *